US009196439B2

(12) United States Patent
Gentsch

(10) Patent No.: US 9,196,439 B2
(45) Date of Patent: Nov. 24, 2015

(54) VACUUM INTERRUPTER ARRANGEMENT FOR A CIRCUIT BREAKER

(71) Applicant: ABB Technology AG, Zürich (CH)

(72) Inventor: Dietmar Gentsch, Ratingen (DE)

(73) Assignee: ABB TECHNOLOGY AG, Zürich (CH)

( * ) Notice: Subject to any disclaimer, the term of this patent is extended or adjusted under 35 U.S.C. 154(b) by 0 days.

(21) Appl. No.: 13/925,151

(22) Filed: Jun. 24, 2013

(65) Prior Publication Data

US 2013/0284704 A1 Oct. 31, 2013

Related U.S. Application Data

(63) Continuation of application No. PCT/EP2011/006425, filed on Dec. 20, 2011.

(30) Foreign Application Priority Data

Dec. 23, 2010 (EP) ..... 10016004

(51) Int. Cl.
*H01H 33/666* (2006.01)

(52) U.S. Cl.
CPC ..... *H01H 33/666* (2013.01); *H01H 2033/6665* (2013.01); *H01H 2033/6668* (2013.01)

(58) Field of Classification Search
CPC .. H01H 33/14; H01H 33/92; H01H 33/66261
USPC ..... 218/140, 118, 132, 136, 146, 147, 10, 218/47, 77
See application file for complete search history.

(56) References Cited

U.S. PATENT DOCUMENTS

| | | | | |
|---|---|---|---|---|
| 7,939,777 | B2 * | 5/2011 | Dullni et al. | 218/136 |
| 8,445,804 | B2 * | 5/2013 | Schellekens et al. | 218/139 |
| 2004/0232112 | A1 | 11/2004 | Kobayashi et al. | |

FOREIGN PATENT DOCUMENTS

| | | | |
|---|---|---|---|
| DE | 1 203 857 | B | 10/1965 |
| JP | 1996-264084 | * | 10/1996 |
| JP | 1997-320412 | * | 12/1997 |
| JP | 2004-241204 | A | 8/2004 |
| JP | 2008-311036 | A | 12/2008 |

OTHER PUBLICATIONS

Machine translation of JP 2004-241204, JP 09-320412 and JP 08-264084 are attached to OA.*

(Continued)

*Primary Examiner* — Renee S Luebke
*Assistant Examiner* — William Bolton
(74) *Attorney, Agent, or Firm* — Buchanan Ingersoll & Rooney PC

(57) ABSTRACT

A vacuum interrupter arrangement for a circuit breaker includes a first cylindrical shaped vacuum insert within which a pair of corresponding electrical contacts is coaxially arranged. The electrical contacts include a fixed electrical contact which is attached to the first vacuum insert and an axially movable electrical contact which is operated by a pushrod. A second cylindrical shaped vacuum insert is coaxially arranged to the first cylindrical shaped vacuum insert. Both vacuum inserts are coaxially surrounded by an outer vacuum container in order to form a double contact gap version.

22 Claims, 2 Drawing Sheets

(56) References Cited

OTHER PUBLICATIONS

International Search Report (PCT/ISA/210) issued on Mar. 22, 2012, by the European Patent Office as the International Searching Authority for International Application No. PCT/EP2011/006425.

Written Opinion (PCT/ISA/237) issued on Mar. 8, 2011, by the European Patent Office as the International Searching Authority for International Application No. PCT/EP2011/006425.

European Search Report dated Apr. 28, 2011.

* cited by examiner

VACUUM INTERRUPTER ARRANGEMENT FOR A CIRCUIT BREAKER

RELATED APPLICATIONS

This application claims priority as a continuation application under 35 U.S.C. §120 to PCT/EP2011/006425, which was filed as an International Application on Dec. 20, 2011 designating the U.S., and which claims priority to European Application 10 016 004.3 filed in Europe on Dec. 23, 2010. The entire contents of these applications are hereby incorporated by reference in their entireties.

FIELD

The present disclosure relates to a vacuum interrupter arrangement for a circuit breaker. The vacuum interrupter arrangement includes a first cylindrical shaped vacuum insert, within which a pair of corresponding electrical contacts is coaxially arranged. The electrical contacts include a fixed electrical contact which is attached to the vacuum insert, and an axially moveable electrical contact which is operated by a push rod.

BACKGROUND INFORMATION

A vacuum interrupter arrangement is provided for medium to high voltage applications. These circuit breakers principally interrupt the current by creating and extinguishing the arc in a vacuum insert which forms an enclosure of a vacuum chamber. Modern vacuum circuit breakers tend to have longer life expectancy than former air circuit breakers. Vacuum circuit breakers replaced air circuit breakers at least for indoor applications. Furthermore, the present disclosure is applicable to modern $SF_6$ circuit breakers having a chamber filled with sulphur hexafluoride gas.

All these circuit breakers are usually used in electrical networks to interrupt short circuit currents as well as load currents and their difficult load impedances. In order to increase the switching safety, especially for high voltage applications, double contact versions of circuit breakers are used, which are the subject of the present disclosure.

SUMMARY

An exemplary embodiment of the present disclosure provides a vacuum interrupter arrangement for a circuit breaker. The exemplary vacuum interrupter arrangement includes a first cylindrical shaped vacuum insert within which a pair of corresponding electrical contacts is coaxially arranged. The electrical contacts include a fixed electrical contact which is attached to the first vacuum insert and an axially movable electrical contact which is operated by a pushrod. The exemplary vacuum interrupter arrangement includes a second cylindrical shaped vacuum insert coaxially arranged to the first cylindrical shaped vacuum insert. Both the first and second vacuum inserts are coaxially surrounded by an outer vacuum container to form a double contact gap version.

BRIEF DESCRIPTION OF THE DRAWINGS

Additional refinements, advantages and features of the present disclosure are described in more detail below with reference to exemplary embodiments illustrated in the drawings, in which.

The reference symbols used in the drawings and their meanings are listed in summary form in the list of reference symbols. In principle, identical parts are provided with the same reference symbols in the figures. All the figures are schematic as mentioned above.

DETAILED DESCRIPTION

Figure 1:
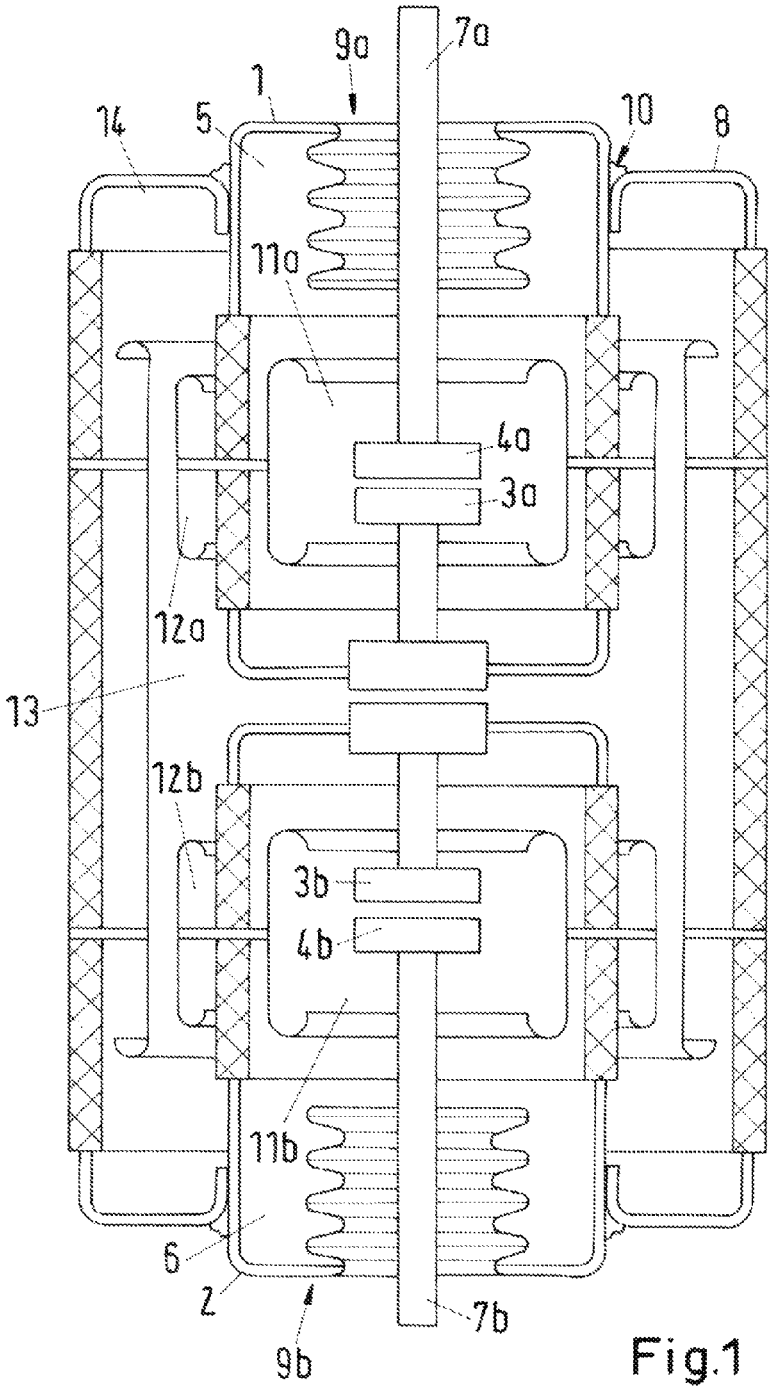
FIG. 1 shows a schematic side view of a vacuum interrupter arrangement with first and second cylindrical shaped vacuum inserts which are independently operated.

Exemplary embodiments of the present disclosure provide a vacuum interrupter arrangement in a double contact gap version that is configured to securely switch high voltage across the whole vacuum interrupter length.

An exemplary embodiment of the present disclosure provides a vacuum interrupter arrangement for a circuit breaker. The exemplary vacuum interrupter arrangement includes a first cylindrical shaped vacuum insert within which a pair of corresponding electrical contacts is coaxially arranged. The electrical contacts include a fixed electrical contact which is attached to the first vacuum insert and an axially movable electrical contact which is operated by a pushrod. The exemplary vacuum interrupter arrangement includes a second cylindrical shaped vacuum insert coaxially arranged to the first cylindrical shaped vacuum insert. Both the first and second vacuum inserts are coaxially surrounded by an outer vacuum container to form a double contact gap version.

According to an exemplary embodiment of the present disclosure, a second cylindrical shaped vacuum insert is coaxially arranged to the first cylindrical shaped vacuum insert in order to form a double contact gap version of a vacuum interrupter arrangement. Furthermore, both vacuum inserts are coaxially surrounded by an outer vacuum container.

This arrangement provides vacuum containers for each pair of electrical contacts in a further common vacuum container. This arrangement results in a secure high voltage vacuum interrupter device with a compact design. Only a few parts are assembled together, wherein known vacuum inserts for a pair of electrical contacts are applicable in order to form in combination the double contact gap circuit breaker. In other words, a high voltage vacuum interrupter arrangement according to the present disclosure may include standard vacuum inserts which are concentric surrounded by a second vacuum enclosure.

The vacuum chamber inside each vacuum insert may be evacuated and manually contain a vacuum. It is to be understood that the vacuum inside the vacuum inserts does not have to be a perfect vacuum and that a nearly vacuum may be sufficient. The pair of electrical contacts inside the first and second vacuum insert, respectively, each includes two contacts that in a closed state of the respective vacuum insert are touching each other and that in an open state of the vacuum insert are separated from each other with a vacuum between them.

Due to the vacuum between the electrical contacts in the open state, even a high current, the generation of arcs between the contacts, for example, due to over voltage, may be avoided. In a double contact gap version, that effect increases. According to an exemplary embodiment of the present disclosure, the outer vacuum container is designed as a hollow cylinder, and the first and second vacuum inserts are at least partly inserted into the opposite openings of the vacuum container.

In accordance with an exemplary embodiment of the present disclosure, both vacuum inserts are sealed to the other vacuum container by bracing with a metal bracing alloy along the edge of the corresponding opening. That bracing solution allows for a fast and secure fixation of the outer vacuum container onto both vacuum inserts which are arranged coaxially one to another. For a single gap contact version, it is also possible to surround a single vacuum insert by a corresponding outer vacuum container. The parts to be connected by bracing are at least in the area of the braced seam of metal material. In contrast, the remaining areas of the parts may be composed of an insulation plastic material.

According to an exemplary embodiment of the present disclosure, the vacuum chambers of both vacuum inserts are interconnected using a hole or a conduit between both vacuum inserts. The inter-connection forms a common vacuum atmosphere in order to compensate pressure differences between both vacuum chambers. Alternatively, it is also possible to separate both vacuum chambers to get independency during current interruption.

According to an exemplary embodiment of the present disclosure, shielding means are provided for increasing the safety of the vacuum interrupter arrangement especially for high voltage applications. According to an exemplary embodiment, a cylindrical shaped inner metal shield is arranged inside each vacuum insert coaxially surrounding the pair of corresponding electrical contacts.

In order to increase the safety for a double contact gap version, a cylindrically shaped middle metal shield may be arranged outside each vacuum insert, especially coaxially surrounding both inner metal shields, wherein the middle metal shield may be arranged inside the outer vacuum container. By including the metal shields at the vacuum inserts and inside the vacuum inserts, the electrical field distribution can be controlled to keep the voltage on both or more vacuum interrupters 50-50.

That metal shield arrangement provides the full voltage stiffness under high voltage conditions. Especially, by applying several separate vacuum chambers, there will be no influence after a number of current interruption operations and increases the lifetime of the vacuum interrupter arrangement according to the present disclosure.

In order to further increase the high voltage safety, it is possible to arrange an outer metal shield along both vacuum inserts. That cylindrically shaped common outer metal shield can coaxially surround the middle metal shields inside the outer vacuum container. Alternatively, it is also possible that the common outer metal shield is provided instead of both middle metal shields inside the outer vacuum container.

According to an exemplary embodiment of the present disclosure, the first vacuum insert and the second vacuum insert are electrically connected in series by mechanically coupling both fixed electrical contacts one to another. In that configuration, it is possible to switch both vacuum inserts independently via the respective push rods.

It may also be possible that the first and second vacuum inserts are switched simultaneously. For example, both vacuum inserts may electrically connect in series by mechanically coupling both moveable electrical contacts via a common push rod. In accordance with an exemplary embodiment, the common push rod includes a double lever arrangement in order to simultaneously operate both movable electrical contacts.

With such a vacuum interrupter arrangement, the following set up is possible. A first high voltage line is connected to the first vacuum insert, which is connected to a connecting line between the first and the second vacuum insert. Further, the second vacuum insert is connected to a second high voltage line. In case that a common push rod is used between the first and second vacuum insert, the connection line between the first and second vacuum insert can be positioned adjacent to the common eject shaft or other gear means.

Due to this arrangement, it may be possible to use vacuum inserts for applications higher than 52 kV which are known for medium voltage applications. According to this embodiment of the present disclosure, the vacuum inserts are arranged in series and a special safety and shielding conditions.

These and other aspects of the present disclosure will be apparent from and explained in more detail with reference to the exemplary embodiments described hereinafter.

According to the exemplary embodiment illustrated in FIG. 1, a high voltage vacuum interrupter arrangement includes a first cylindrical shaped vacuum insert 1 and a second cylindrical shaped vacuum insert 2. Inside each vacuum insert 1 and 2, a pair of corresponding electrical contacts 3*a*, 4*a* and 3*b*, 4*b* is respectively arranged. Both pairs of electrical contacts 3*a*, 4*a*; 3*b*, 4*b* are arranged inside a vacuum chamber 5 and 6 respectively provided by each vacuum insert 1 and 2.

Each pair of electrical contacts includes a fixed electrical contact 3*a* and 3*b* which is attached to the housing of its vacuum insert 1 and 2, respectively. The corresponding electrical contact 4*a* and 4*b* is axially movably arranged within the respective vacuum insert 1 and 2, respectively. Each moveable electrical contact 4*a* and 4*b* is operated by a respective push rod 7*a* and 7*b* extending to gear means outside the vacuum interrupter arrangement. Since it is possible to move both moveable electrical contacts 4*a* and 4*b* by separate actuator means, the first vacuum insert 1 and the second vacuum insert 2 are configured to be operated independently. Since both electrical contacts 3*a* and 3*b* are mechanically coupled to one another, both vacuum inserts 1 and 2 are electrically connected in series.

In order to form a double gap version, the first cylindrical shaped vacuum insert 1 is coaxially arranged to the second cylindrical shaped vacuum insert 2. Both vacuum inserts 1 and 2 are coaxially surrounded by an outer vacuum container 8 which provides a higher level of safety for high voltage applications.

The outer vacuum container 8 is designed as a hollow cylinder. The first and second vacuum inserts 1 and 2 are partly inserted into opposite openings 9*a* and 9*b* of the vacuum container 8. Both vacuum inserts 1 and 2 are sealed to the outer vacuum container 8 using a metal bracing alloy 10 by bracing along the edge of the corresponding opening 9*a* and 9*b* in order to form a third vacuum chamber 11.

In order to increase the electrical safety inside each vacuum insert 1 and 2, a cylindrically shaped inner metal shield 11*a* and 11*b* is respectively arranged. Each inner metal shield 11*a* and 11*b* surrounds the pair of corresponding electrical contacts 3*a*, 4*a* and 3*b*, 4*b*, respectively.

Furthermore, outside each vacuum insert 1 and 2, a respective cylindrically shaped middle shield 12*a* and 12*b* is arranged. Both middle metal shields 12*a* and 12*b* coaxially surround the inner metal shields 11*a* and 11*b*, respectively, and they are arranged inside the third vacuum chamber 14 of the outer vacuum container 8.

In addition to the electrical shielding means as described above, a common cylindrical shaped outer metal shield 13 is arranged outside of both vacuum inserts 1 and 2 inside and along the third vacuum chamber 14. In the radial direction, the outer metal shield 13 surrounds both middle metal shields 12*a* and 12*b* which are also accommodated inside the third vacuum chamber 14 of the outer vacuum container 8.

Figure 2:
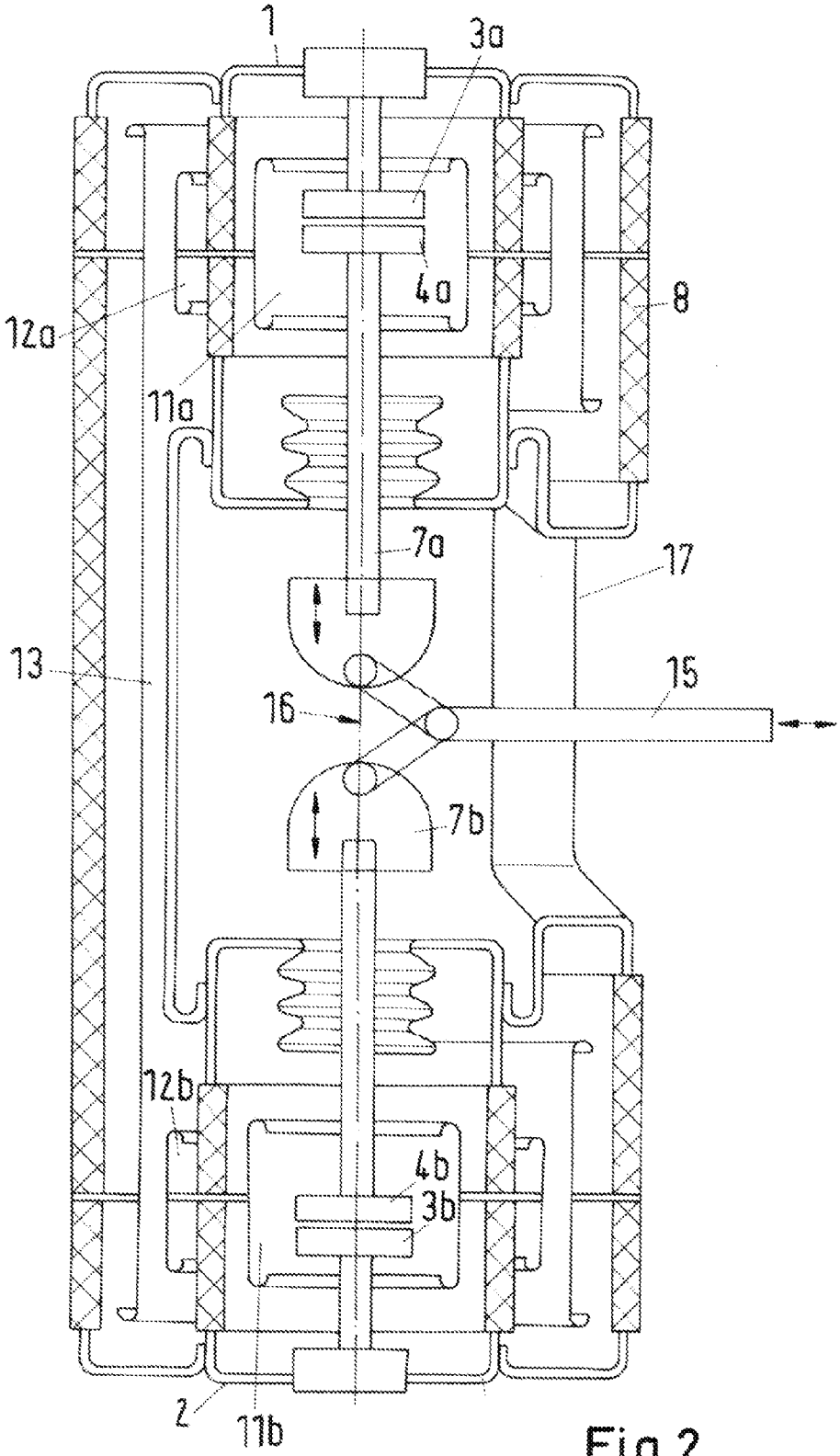
FIG. 2 shows a schematic side view of a vacuum interrupter arrangement with first and second cylindrical shaped vacuum inserts which are simultaneously operated.

According to the exemplary embodiment illustrated in FIG. 2, the vacuum interrupter arrangement includes two coaxially arranged vacuum inserts 1 and 2, each having a fixed electrical contact 3*a* and 3*b*, respectively, which corresponds with a moveable electrical contact 4*a* and 4*b*, respectively. In contrast to the exemplary embodiment illustrated in FIG. 1, both fixed electrical contacts 3*a* and 3*b* are arranged on the opposite ends of the vacuum interrupter arrangement fixed to its vacuum insert 1 and 2, respectively, on which an electrical part is provided.

The adjacent arranged moveable electrical contacts 4*a* and 4*b* are linked to a common push rod 15 in order to switch both vacuum inserts 1 and 2 simultaneously.

The common push rod 15 includes a double lever arrangement 16 which is pivotally attached to the push rod 7*a* and 7*b* of the respective vacuum insert 1 and 2.

In order to increase the electrical safety, the exemplary embodiment illustrated in FIG. 2 also includes a pair of inner metal shields 11*a* and 11*b* for the respective vacuum insert 1 and 2 which are outside surrounded by respective middle metal shields 12*a* and 12*b*. Additionally, an outer metal shield 13 surrounds both middle metal shields 12*a* and 12*b* and is arranged inside the outer vacuum container 8. On the lateral area of the bottom vacuum container 8, a recess 17 is provided through which the common push rod 15 extends to the inner double lever arrangement 16.

It will be appreciated by those skilled in the art that the present disclosure can be embodied in other specific forms without departing from the spirit or essential characteristics thereof. The presently disclosed embodiments are therefore considered in all respects to be illustrative and not restricted. The scope of the disclosure is indicated by the appended claims rather than the foregoing description and all changes that come within the meaning and range and equivalence thereof are intended to be embraced therein.

REFERENCE SYMBOLS

1 First vacuum container
2 Second vacuum container
3 Fixed electrical contact
4 Moveable electrical contact
5 First vacuum chamber
6 Second vacuum chamber
7 Push rod
8 Outer vacuum container
9 Opening
10 Bracing alloy
11 Inner metal shield
12 Middle metal shield
13 Outer metal shield
14 Third vacuum chamber
15 Common push rod
16 Double lever arrangement
17 Recess

What is claimed is:

1. A vacuum interrupter arrangement for a circuit breaker, comprising:

a first cylindrical shaped vacuum insert within which a first pair of corresponding electrical contacts is coaxially arranged, the first pair of electrical contacts including a first fixed electrical contact which is attached to the first vacuum insert and a first axially movable electrical contact which is configured to be operated by a first pushrod;

a second cylindrical shaped vacuum insert coaxially arranged to the first cylindrical shaped vacuum insert and electrically connected in series with the first vacuum insert, the second vacuum insert having coaxially arranged therein a second pair of corresponding electrical contacts, the second pair of electrical contacts including a second fixed electrical contact which is attached to the second vacuum insert and a second axially movable electrical contact which is configured to be operated by a second pushrod;

an outer vacuum container coaxially surrounding both the first and second vacuum inserts, the outer vacuum container forming a double contact gap version;

a first inner metal shield arranged inside the first vacuum insert and coaxially surrounding the first pair of electrical contacts in the first vacuum insert;

a second inner metal shield arranged inside the second vacuum insert and coaxially surrounding the second pair of electrical contacts in the second vacuum insert; and a common metal shield arranged outside the first and second vacuum inserts and coaxially surrounding both the first and second inner metal shields inside the outer vacuum container.

2. The vacuum interrupter arrangement according to claim 1, wherein the outer vacuum container is designed as a hollow cylinder, and the first and second vacuum inserts are at least partly inserted into opposite openings of the outer vacuum container.

3. The vacuum interrupter arrangement according to claim 2, wherein both the first and second vacuum inserts are sealed to the outer vacuum container by brazing with a metal brazing alloy along an edge of the corresponding opening to form a third vacuum chamber.

4. A medium voltage circuit-breaker comprising at least one vacuum interrupter arrangement according to claim 2.

5. A medium voltage circuit-breaker comprising at least one vacuum interrupter arrangement according to claim 3.

6. The vacuum interrupter arrangement according to claim 1, wherein both the first and second vacuum inserts include a separate vacuum chamber.

7. The vacuum interrupter arrangement according to claim 6, wherein the vacuum chambers are interconnected via a hole or a conduit between both the first and second vacuum inserts.

8. A medium voltage circuit-breaker comprising at least one vacuum interrupter arrangement according to claim 6.

9. A medium voltage circuit-breaker comprising at least one vacuum interrupter arrangement according to claim 7.

10. The vacuum interrupter arrangement according to claim 1, wherein both the first and second vacuum inserts are electrically connected in series by mechanically coupling both fixed electrical contacts to one another.

11. A medium voltage circuit-breaker comprising at least one vacuum interrupter arrangement according to claim 10.

12. The vacuum interrupter arrangement according to claim 1, wherein both the first and second vacuum inserts are electrically connected in series by mechanically coupling both the first and second movable electrical contacts via a third pushrod which is commonly connected to both the first and second pushrods of the first and second vacuum inserts, respectively.

13. The vacuum interrupter arrangement according to claim 12, wherein the common pushrod comprises a double lever arrangement configured to simultaneously operate both the first and second movable electrical contacts.

14. A medium voltage circuit-breaker comprising at least one vacuum interrupter arrangement according to claim 13.

15. A medium voltage circuit-breaker comprising at least one vacuum interrupter arrangement according to claim 1.

16. The vacuum interrupter arrangement according to claim 1, comprising:

a contact arrangement pivotally connected to the first pushrod and to the second pushrod; and a third pushrod configured to be connected to the contact arrangement to commonly operate the first pushrod and the second pushrod simultaneously.

17. The vacuum interrupter arrangement according to claim 1, comprising:

a first middle shield arranged outside of the first vacuum insert and coaxially surrounding the first pair of electrical contacts inside the outer vacuum container; and a second middle shield arranged outside of the second vacuum insert and coaxially surrounding the second pair of electrical contacts inside the outer vacuum container, wherein the common metal shield coaxially surrounds both the first middle shield and the second middle shield inside the outer vacuum container.

18. The vacuum interrupter arrangement according to claim 17, wherein the first and second inner shields, the first and second middle shields, and the common shield are each cylindrically shaped, respectively.

19. A medium voltage circuit-breaker comprising at least one vacuum interrupter arrangement according to claim 17.

20. The vacuum interrupter according to claim 17, wherein the common metal shield coaxially and commonly surrounds the entireties of each of the first and second inner metal shields and the first and second middle shields inside the outer vacuum container.

21. The vacuum interrupter arrangement according to claim 1, wherein the common metal shield coaxially and commonly surrounds the first and second inner metal shields in their entireties inside the outer vacuum container.

22. The vacuum interrupter arrangement according to claim 1, wherein the first inner shield is arranged entirely inside the first vacuum insert, and the second inner shield is arranged entirely inside the second vacuum insert.

* * * * *